US011398153B1

(12) United States Patent
Nayak et al.

(10) Patent No.: US 11,398,153 B1
(45) Date of Patent: Jul. 26, 2022

(54) SYSTEM AND METHOD FOR DETERMINING A DRIVING DIRECTION

(71) Applicant: HERE Global B.V., Eindhoven (NL)

(72) Inventors: Amarnath Nayak, Mumbai (IN); Leon Stenneth, Chicago, IL (US); Alex Averbuch, Buffalo Grove, IL (US)

(73) Assignee: HERE Global B.V., Eindhoven (NL)

( * ) Notice: Subject to any disclaimer, the term of this patent is extended or adjusted under 35 U.S.C. 154(b) by 0 days.

(21) Appl. No.: 17/190,246

(22) Filed: Mar. 2, 2021

(51) Int. Cl.
*G08G 1/056* (2006.01)
*G08G 1/0968* (2006.01)

(52) U.S. Cl.
CPC ..... *G08G 1/096855* (2013.01); *G08G 1/056* (2013.01)

(58) Field of Classification Search
None
See application file for complete search history.

(56) References Cited

U.S. PATENT DOCUMENTS 6,577,948 B1 * 6/2003 Skellenger ..... G01C 21/26 701/72
8,751,157 B2 6/2014 Simon
10,089,878 B2 10/2018 Cummings, II et al.
2009/0164080 A1 * 6/2009 Kurata ..... B60W 50/16 701/70
2009/0164082 A1 * 6/2009 Kobayashi ..... B60K 31/0008 701/96
2014/0032093 A1 * 1/2014 Mills ..... B60W 40/10 701/301
2015/0360610 A1 * 12/2015 Reed ..... B60Q 9/008 340/425.5
2018/0061226 A1 * 3/2018 Thelen ..... G05D 1/0278
2018/0284260 A1 * 10/2018 Oyaizu ..... G01C 3/06
2018/0365989 A1 12/2018 Song et al.
2019/0186948 A1 * 6/2019 Hayee ..... B60Q 9/00

OTHER PUBLICATIONS

Tao et al., "Wrong Roadway Detection for Multi-Lane Roads", retrieved from https://www.researchgate.net/profile/Reinhard-Klette/publication/257579974_Wrong_Roadway_Detection_for_Multi-Lane_Roads/inks/546531210cf2052b509f2dbd/Wrong-Roadway-Detection-for-Multi-Lane-Roads.pdf, Aug. 2013, 8 pages.

* cited by examiner

*Primary Examiner* — John F Mortell
(74) *Attorney, Agent, or Firm* — Ditthavong, Steiner & Mlotkowski

(57) ABSTRACT

A system is disclosed for determining a driving direction. The system may include a memory configured to store computer-executable instructions; and at least one processor configured to execute the computer-executable instructions to obtain sensor data associated with a vehicle. The sensor data may include at least location data of the vehicle and lateral position data of the vehicle. Further, the processor is configured to execute the computer-executable instructions to identify a link associated with the sensor data, based on the location data and map data. Furthermore, the processor is configured to execute the computer-executable instructions to calculate half width data associated with the link based on the lateral position data and determine the driving direction for the vehicle based on the half width data, the lateral position data, and vehicle width data.

20 Claims, 9 Drawing Sheets

SYSTEM AND METHOD FOR DETERMINING A DRIVING DIRECTION

TECHNOLOGICAL FIELD

The present disclosure generally relates to routing and navigation systems, and more particularly relates to determining a driving direction for routing and navigation systems.

BACKGROUND

Accidents are a major cause of concern while driving, for both users and vehicle makers, worldwide. The serious implications of accidents, particularly the risk of accidents being fatal, is a grave concern and one of the most important safety parameters that all the concerned parties: vehicle owners, vehicle makers and vehicle navigation service providers, want to ensure. Research has shown that over the last few decades, 5% of worldwide accidents have been caused by wrong-way driving. Wrong-way driving may occur when a driver, operating a vehicle, is traveling in a wrong driving direction on a road segment or on a lane of the road segment. The wrong driving direction may be a travel direction that is opposite to a legal travel direction of the road segment or the lane of the road segment. In most of cases, the driver may travel in the wrong driving direction, when the driver is confused with complex road geometries, placement of a new link, and the like. This confusion may lead to accidents, causing serious harm to users and vehicles alike, and should be avoided.

BRIEF SUMMARY OF SOME EXAMPLE EMBODIMENTS

In case of accidents caused by wrong-way driving, the underlying cause could be that the determination of the driving direction as the right way driving direction or the wrong way driving direction becomes a challenging task due to complex road geometries. Further, the determination of driving direction of the vehicle as the right way driving direction or the wrong way driving direction becomes even more challenging in autonomous driving applications.

In order to solve the foregoing problem, the present disclosure provides a system that may determine the driving direction, based on sensor data collected from sensors of the vehicle such that unwanted conditions such as road accidents, head-on collisions of vehicles, fatalities and the like are avoided irrespective of complexity of the road geometry and the like.

Various embodiments are provided herein for obtaining the sensor data associated with the vehicle. The sensor data associated with the vehicle may include at least location data of the vehicle and lateral position data of the vehicle. In various embodiments, the sensor data may be continuously obtained at predefined frequency. In various embodiments, the lateral position data may correspond to distance data indicative of distance from centre of the vehicle to a boundary of a road segment and/or a link.

Various embodiments are provided for identifying the link associated with the sensor data, based on the location data and map data. In various embodiments, the link may be identified by map-matching the location data to the map data.

Various embodiments are provided for calculating half width data associated with the link, based on the lateral position data. In various embodiments, the half width data associated with the link may be calculated by determining a first lateral position data and a second lateral position data for the link. As used herein, the first lateral position data may correspond to distance data indicative of distance from the centre of the vehicle to a right boundary of the link. As used herein, the second lateral position data may correspond to distance data indicative of distance from the centre of the vehicle to a left boundary of the link.

Various embodiments are provided for determining the driving direction, based on the half width data, the lateral position data, and vehicle width data. In various embodiments, the driving direction may be determined as at least one of a right-way driving direction and a wrong-way driving direction by comparing a summation of the lateral position data and the vehicle width data with the half width data. In some embodiments, the driving direction may be determined by determining a confidence value based on the half width data, the lateral position data, and the vehicle width data.

Various embodiments are provided for generating a notification, based on the confidence value. In some example embodiments, the notification may be generated if the confidence value is close to one. The confidence value may indicate a confidence in the outcome of any determination. A value close to one indicates a higher confidence and thus more chances of the decision outcome being accurate. A value close to zero indicates lesser confidence and thus less chances of the decision outcome being accurate. In some other example embodiments, the notification may not be generated just by using one confidence value for a particular location of the vehicle, to address inconsistencies in GPS error, road geometries and the like. To that end, the notification may be generated by determining the confidence value for a plurality of locations associated with the vehicle. In various embodiments, the plurality of locations may be consecutive number of locations. Further, the generated notification may be provided to avoid the unwanted conditions such as road accidents (e.g., head-on collisions of vehicles), vehicle damages, fatalities, and the like.

A system, a method and a computer programmable product are provided in accordance with an example embodiment described herein for determining a driving direction.

In one aspect, a system for determining the driving direction is disclosed. The system comprises a memory configured to store computer-executable instructions; and at least one processor configured to execute the computer-executable instructions to: obtain sensor data associated with a vehicle, wherein the sensor data comprises at least location data of the vehicle and lateral position data of the vehicle; identify a link associated with the sensor data, based on the location data and map data; calculate half width data associated with the link, based on the lateral position data; and determine the driving direction for the vehicle, based on the half width data, the lateral position data, and vehicle width data.

In additional system embodiments, to determine the driving direction, the processor is further configured to: compare the half width data associated with the link with a combination data, wherein the combination data is a summation of the lateral position data and the vehicle width data; and determine the driving direction as at least one of a right-way driving direction and a wrong-way driving direction, based on the comparison.

In additional system embodiments, the processor is further configured to: determine a confidence value, based on the half width data associated with the link, the lateral position data, and the vehicle width data; determine a consecutive number of locations associated with the vehicle; and generate a notification based on the confidence value, the consecutive number of locations and a set of rules, wherein the notification comprises at least one of an alert message indicative of wrong-way driving, an audio message indicating wrong-way driving, a visual message indicating wrong-way driving, and a navigation instruction related to wrong-way driving.

In additional system embodiments, each rule in the set of rules comprises a threshold confidence value and a threshold number of consecutive locations, and wherein to generate the notification based on the confidence value, the consecutive number of locations, and the set of rules, the processor is further configured to: select a first rule from the set of rules based on the consecutive number of locations, wherein the first rule comprises a first threshold confidence value and a first threshold number of consecutive locations; determine whether the confidence value determined for each of the first threshold number of consecutive locations is greater than the first threshold confidence value; select a second rule from the set of rules, in response to determining the confidence value determined for at least one of the first threshold number of consecutive locations is not greater than the first threshold confidence value, wherein the second rule comprises a second threshold confidence value and a second threshold number of consecutive locations; determine whether the confidence value determined for each of the second threshold number of consecutive locations is greater than the second threshold confidence value; and generate the notification, in response to at least one of: determining the confidence value determined for each of the first threshold number of consecutive locations is greater than the first threshold confidence value and determining the confidence value determined for each of the second threshold number of consecutive locations is greater than the second threshold confidence value.

In additional system embodiments, to calculate the half width data associated with the link, the processor is further configured to: map-match the location data to the link, using the lateral position data and a heading direction data; determine a first lateral position data and a second lateral position data for the link; and calculate the half width data associated with the link, based on the first lateral position data and the second lateral position data.

In additional system embodiments, the processor is further configured to: determine a number of lanes on the link, based on the half width data associated with the link and a threshold lane width; compare the determined number of lanes on the link with a ground truth data associated with the link; and validate the link, based on the comparison.

In additional system embodiments, to identify the link associated the sensor data, the processor is further configured to map-match the location data with the map data to identify the link associated with the sensor data.

In additional system embodiments, the link is a bidirectional link.

In another aspect, a method for determining the driving direction is disclosed. The method includes obtaining sensor data associated with a vehicle, wherein the sensor data comprises at least location data of the vehicle and lateral position data of the vehicle; identifying a link associated with the sensor data, based on the location data and map data; calculating half width data associated with the link, based on the lateral position data; determining a confidence value, based on at least one of the half width data associated with the link, the lateral position data and vehicle width data; and determining the driving direction for the vehicle, based on the confidence value.

In additional method embodiments, the confidence value is determined by an exponential function of the half width data associated with the link, the lateral position data, and the vehicle width data.

In additional method embodiments, determining the driving direction further comprises determining the driving direction as at least one of a right-way driving direction and a wrong-way driving direction, based on the confidence value.

In additional method embodiments, the method further comprises: determining a consecutive number of locations associated with the vehicle; generating a notification based on the confidence value, the consecutive number of locations, and a set of rules, wherein the notification comprises at least one of an alert message, an audio message indicating wrong-way driving, a visual message indicating wrong-way driving, and a navigation instruction related to wrong-way driving.

In additional method embodiments, each rule in the set of rules comprises a threshold confidence value and a threshold number of consecutive locations, and wherein generating the notification based on the confidence value, the consecutive number of locations, and the set of rules further comprises: selecting a first rule from the set of rules, based on the consecutive number of locations, wherein the first rule comprises a first threshold confidence value and a first threshold number of consecutive locations; determining whether the confidence value determined for each of the first threshold number of consecutive locations is greater than the first threshold confidence value; selecting a second rule from the set of rules, in response to determining the confidence value determined for at least one of the first threshold number of consecutive locations is not greater than the first threshold confidence value, wherein the second rule comprises a second threshold confidence value and a second threshold number of consecutive locations; determining whether the confidence value determined for each of the second threshold number of consecutive locations is greater than the second threshold confidence value; and generating the notification, in response to at least one of: determining the confidence value determined for each of the first threshold number of consecutive locations is greater than the first threshold confidence value and determining the confidence value determined for each of the second threshold number of consecutive locations is greater than the second threshold confidence value.

In additional method embodiments, calculating the half width data associated with the link further comprises: map-matching the location data to the link, using the lateral position data and a heading direction data; determining a first lateral position data and a second lateral position data for the link; and calculating the half width data associated with the link, based on the first lateral position data and the second lateral position data.

In additional method embodiments, the method further comprises: determining a number of lanes on the link, based on the half width data associated with the link and a threshold lane width; comparing the determined number of lanes on the link with a ground truth data associated with the link; and validating the link, based on the comparison.

In additional method embodiments, the method further comprises: comparing the half width data associated with the link with a combination data, wherein the combination data is a summation of the lateral position data and the vehicle width data; and determining the driving direction as at least one of a right-way driving direction and a wrong-way driving direction, based on the comparison.

In yet another aspect, a computer program product comprising a non-transitory computer readable medium having stored thereon computer executable instruction which when executed by at least one processor, cause the processor to carry out operations for generating a notification, the operations comprising: obtaining sensor data associated with a plurality of locations, wherein the sensor data associated with the plurality of locations comprises at least a plurality of locations and a lateral position data associated with each of the plurality of locations; identifying a link associated with the sensor data, based on the plurality of locations and map data; calculating half width data associated with the link, based on the lateral position data associated with each of the plurality of locations; determining a confidence value for each of the plurality of locations, based on at least one of the half width data associated with the link, the lateral position data associated with each of the plurality of locations, and vehicle width data; generating the notification based on the confidence value for each of the plurality of locations and a set of rules, wherein the set of rules provides at least one threshold confidence value and at least one threshold number of consecutive locations.

In additional computer program product embodiments, for generating the notification, the operations further comprise: determining whether the confidence value for each of the plurality of locations is greater than the at least one threshold confidence value; and generating the notification, if the confidence value for each of the plurality of locations is greater than the at least one threshold confidence value and if a number of the plurality of locations matches with the at least one threshold number of consecutive locations, wherein the notification comprises at least one of an alert message, an audio message indicating wrong-way driving, a visual message indicating wrong-way driving, and a navigation instruction related to wrong-way driving.

In additional computer program product embodiments, the operations further comprising determining, for each of the plurality of locations, a driving direction as at least one of a right-way driving and a wrong-way driving, based on the half width data associated with the link, the lateral position data associated with each of the plurality of locations, and the vehicle width data.

In additional computer program product embodiments, the operations further comprising validating the link based on the half width data associated with the link and a ground truth data associated with the link.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF DRAWINGS

Figure 1:
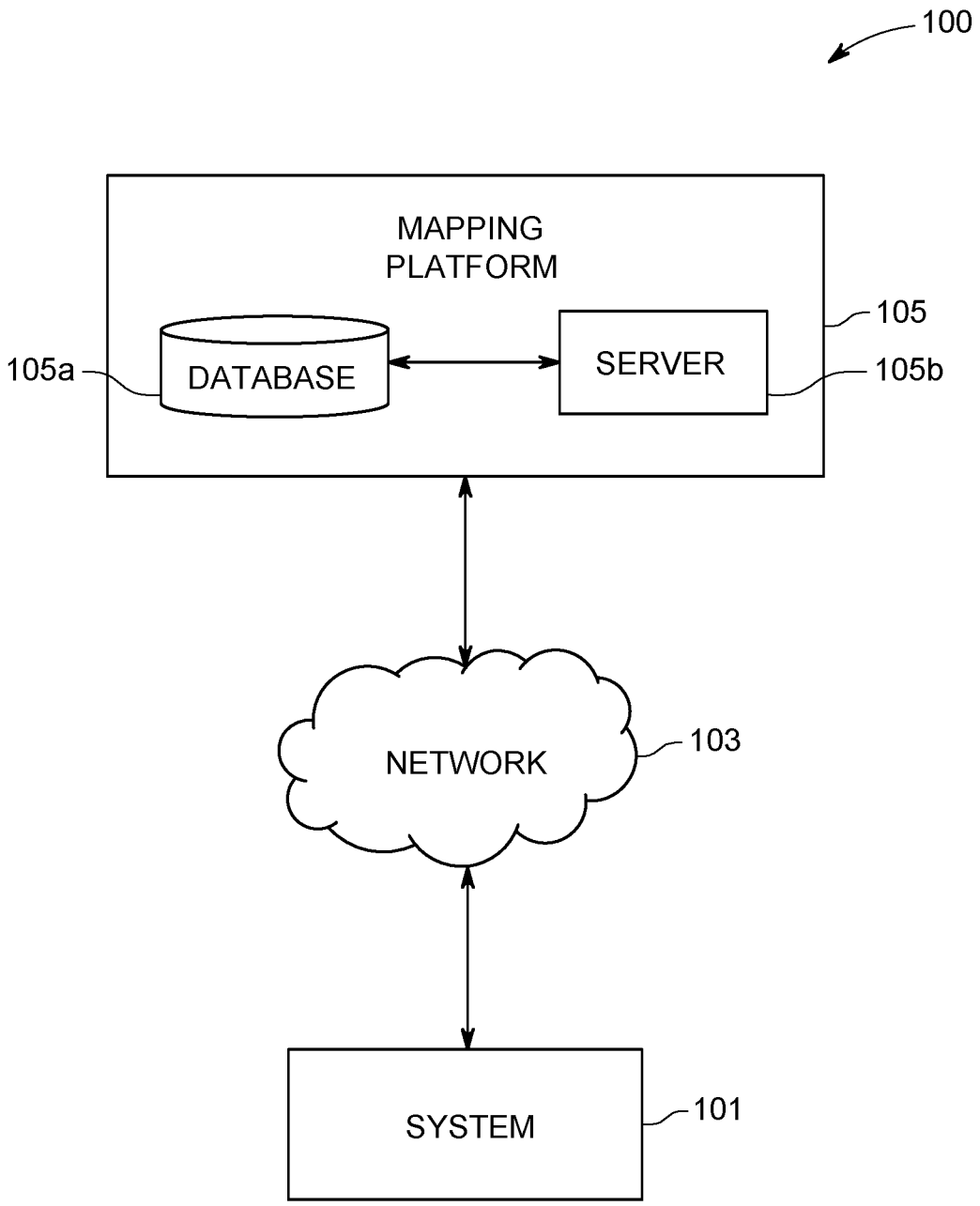
Figure 2:
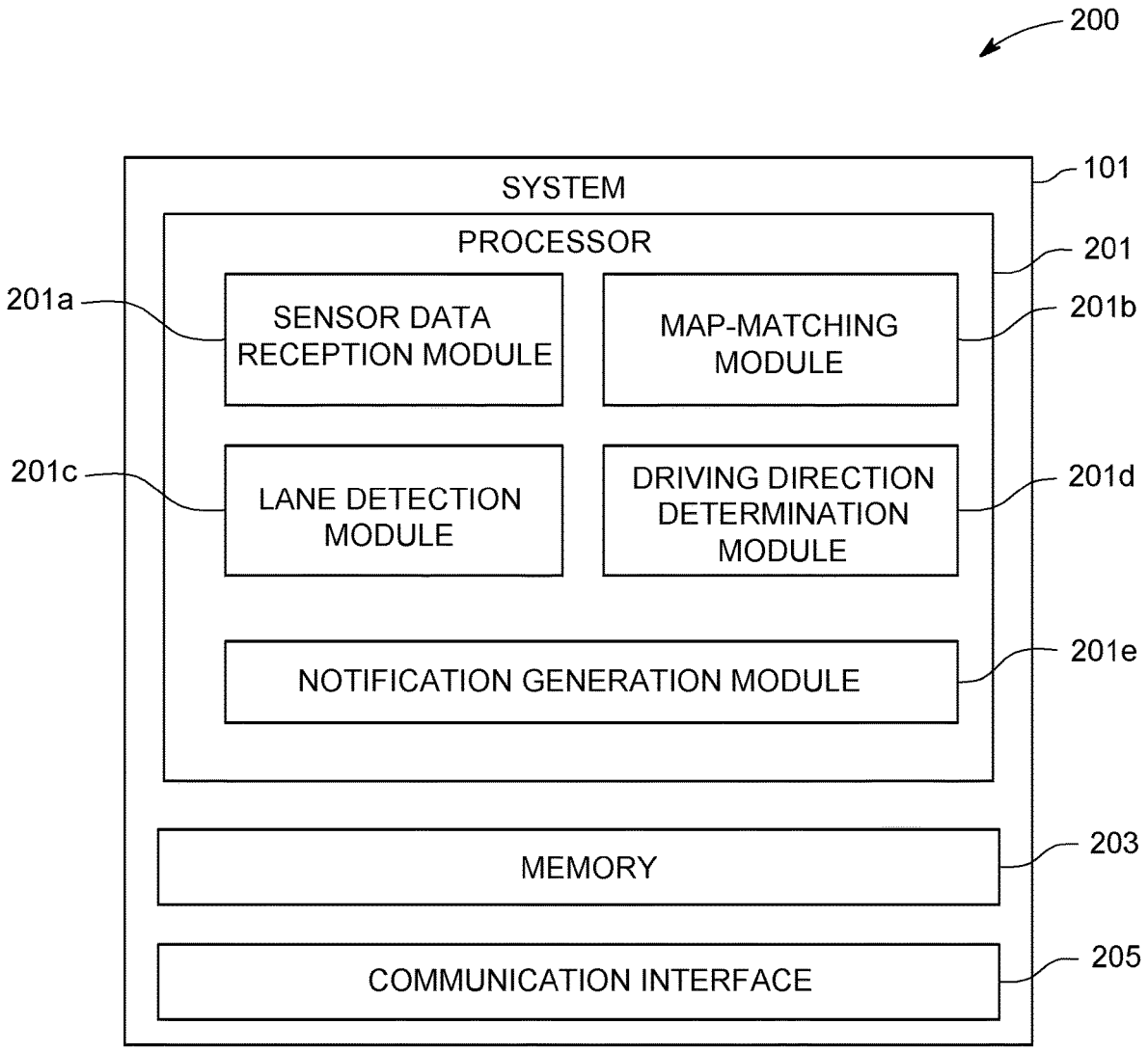
Figure 3A:
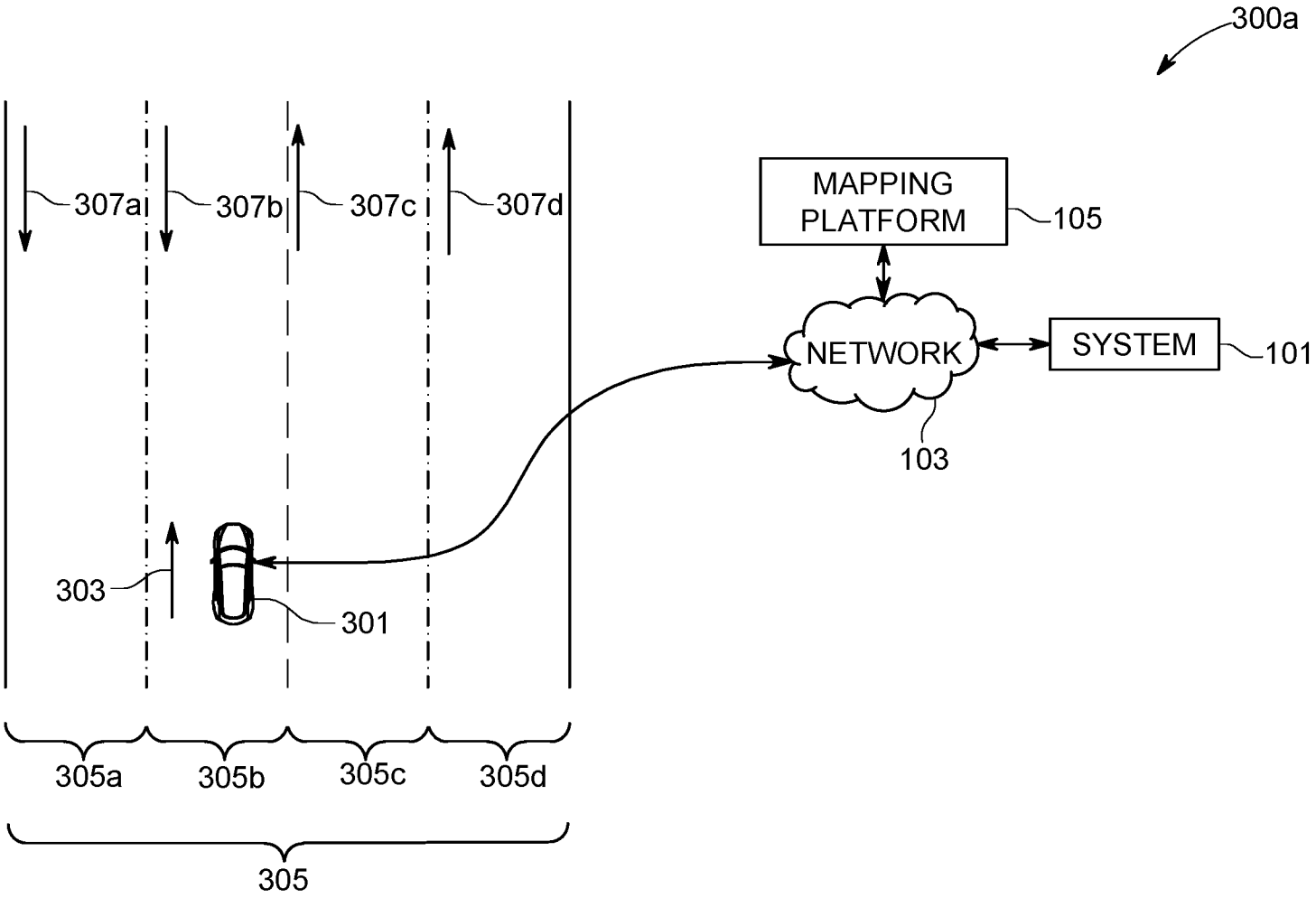
Figure 3B:
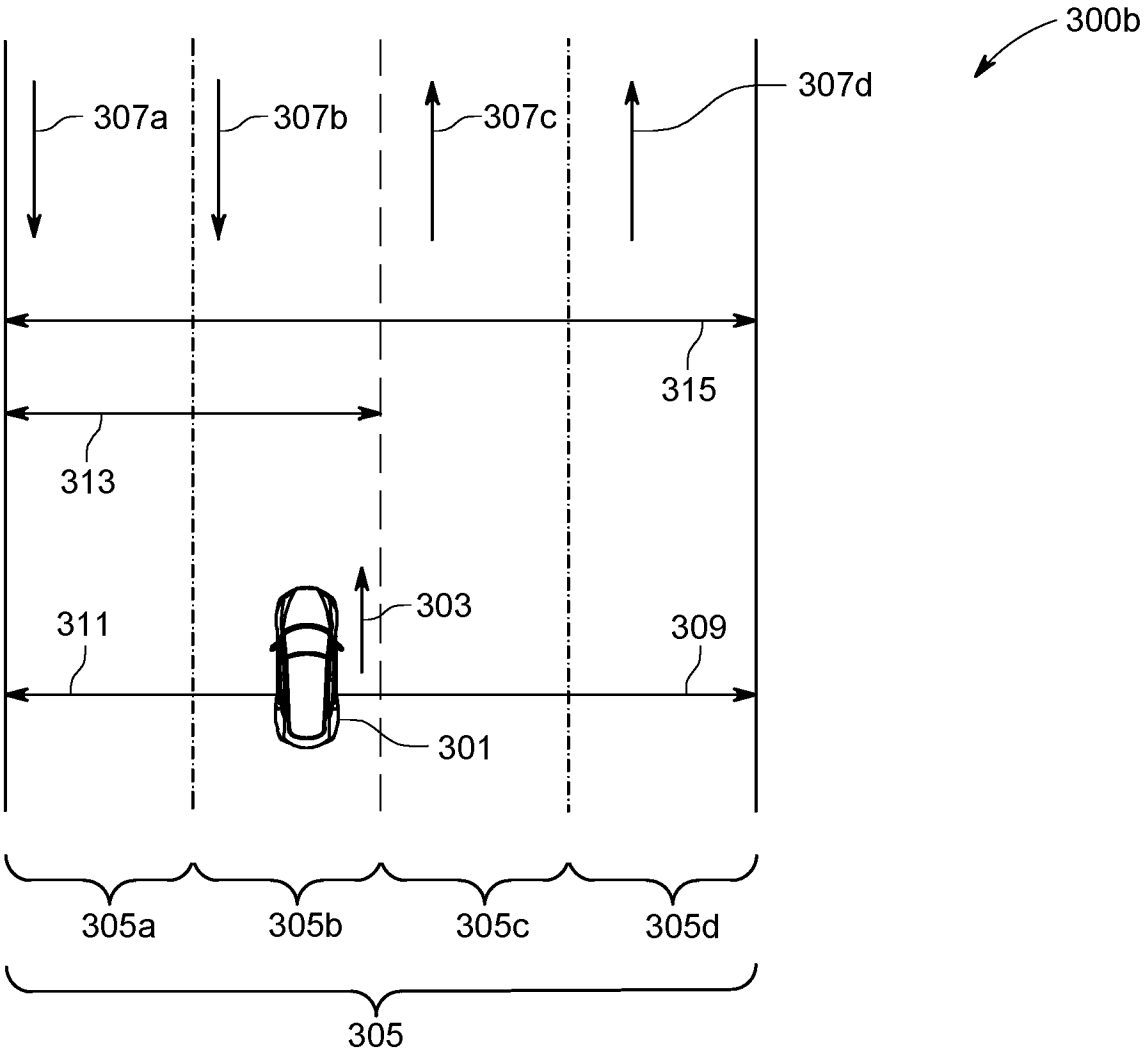
Figure 3C:
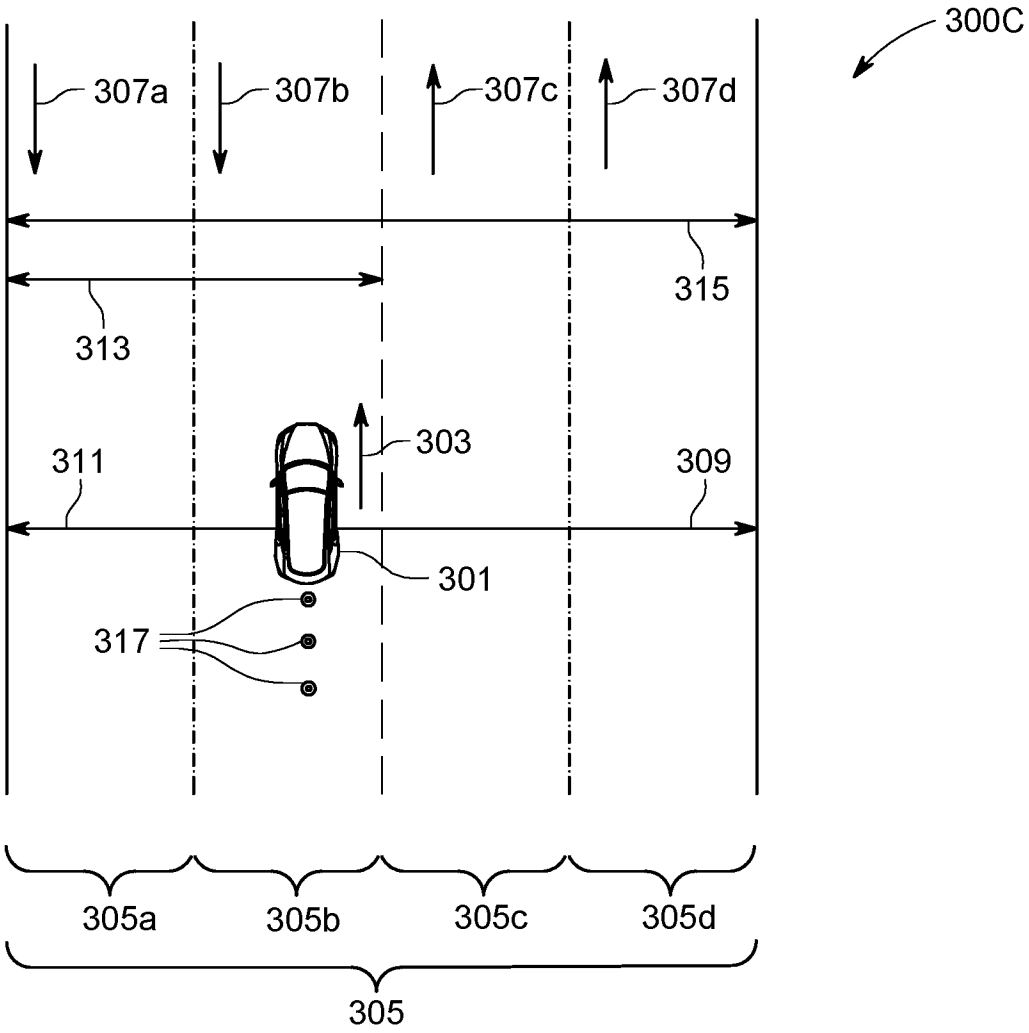
Figure 4:
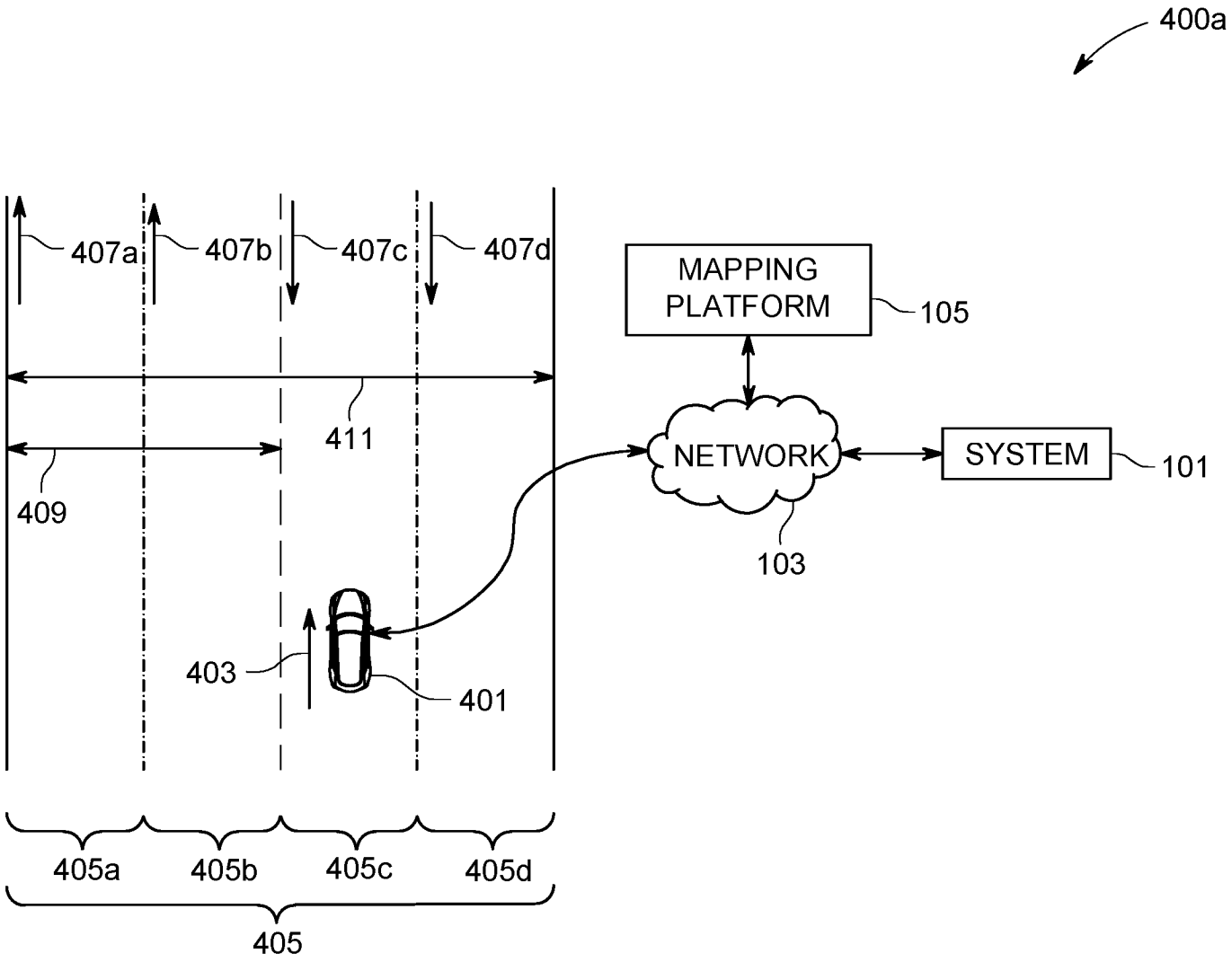
Figure 5:
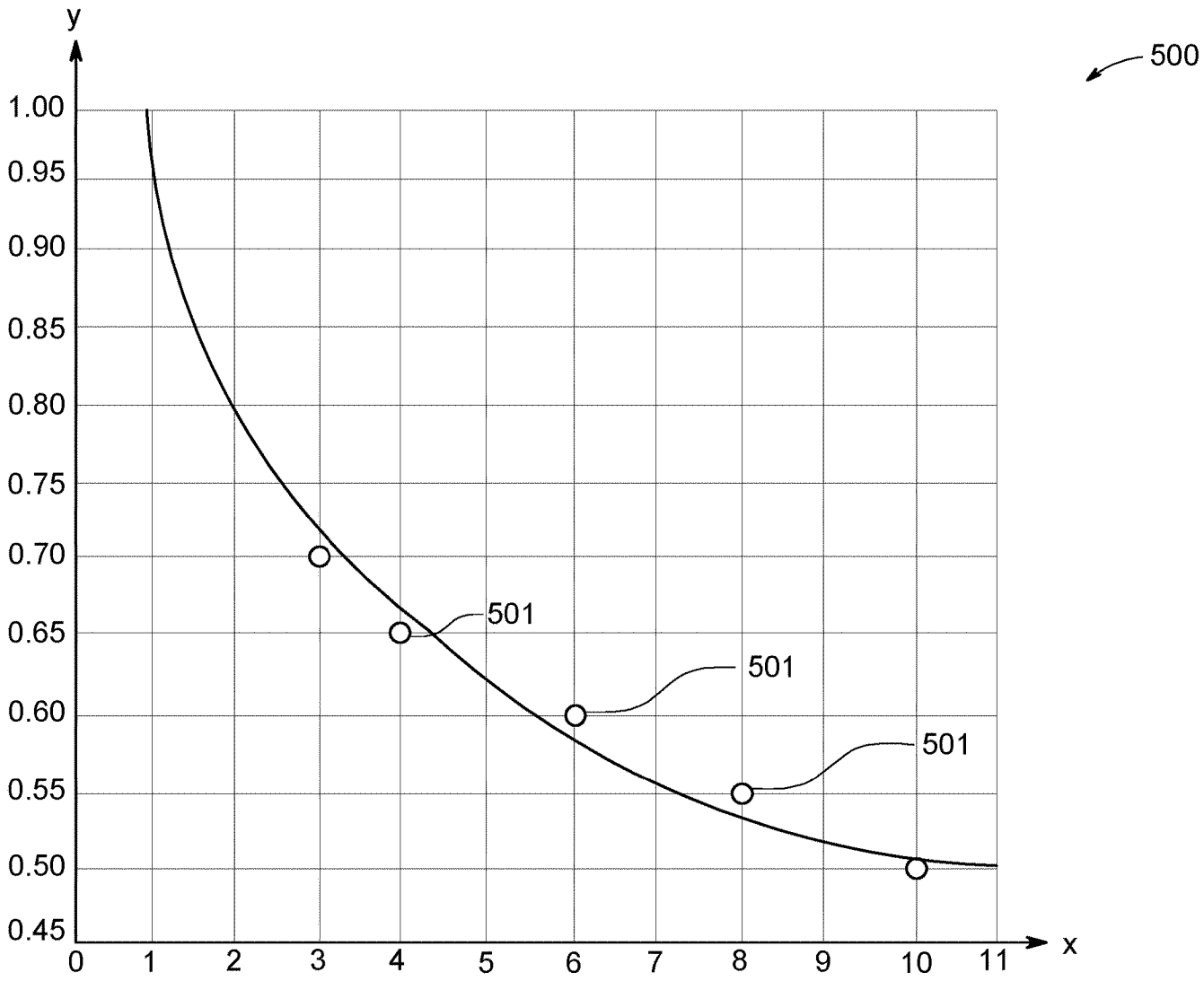
Figure 6A:
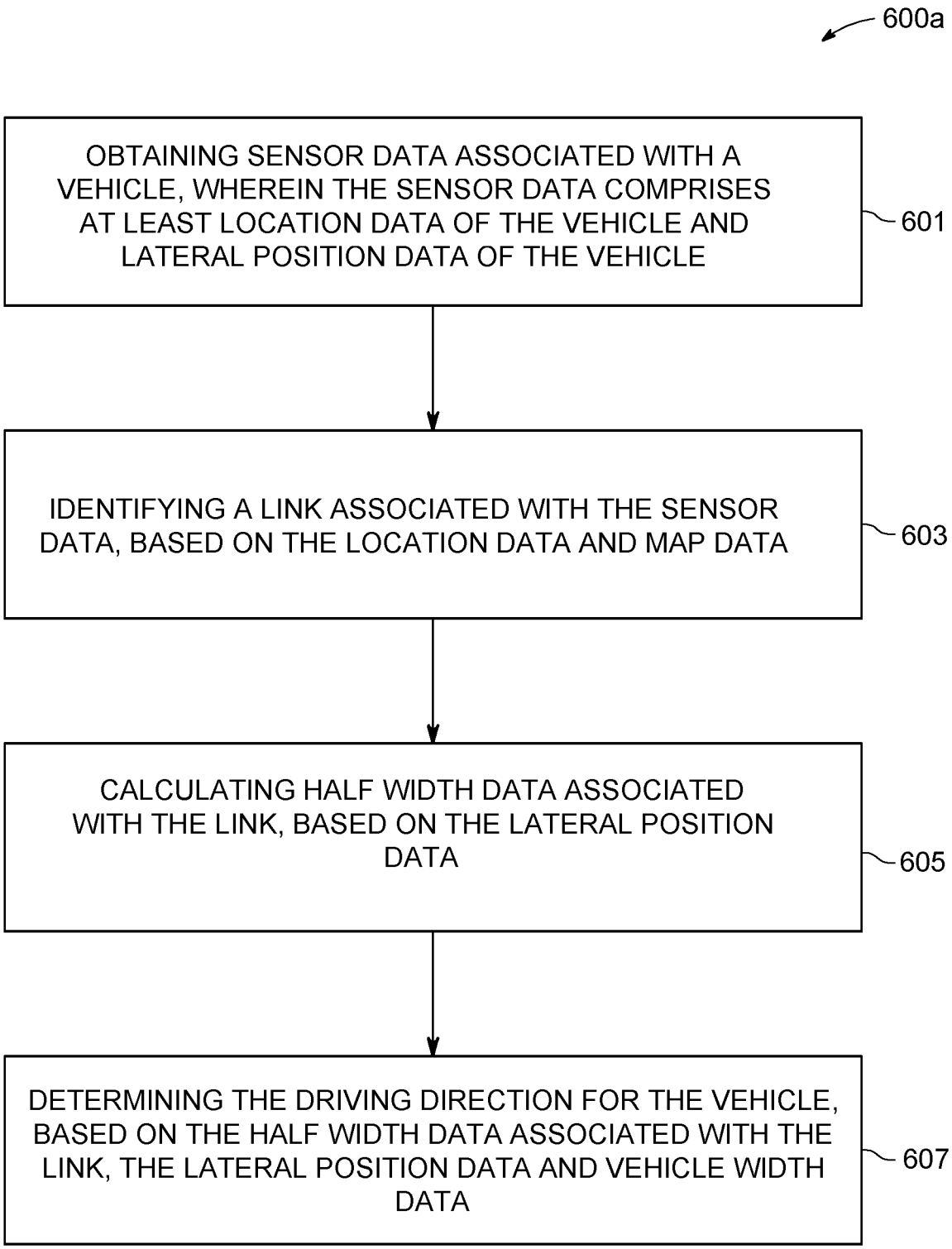
Figure 6B:
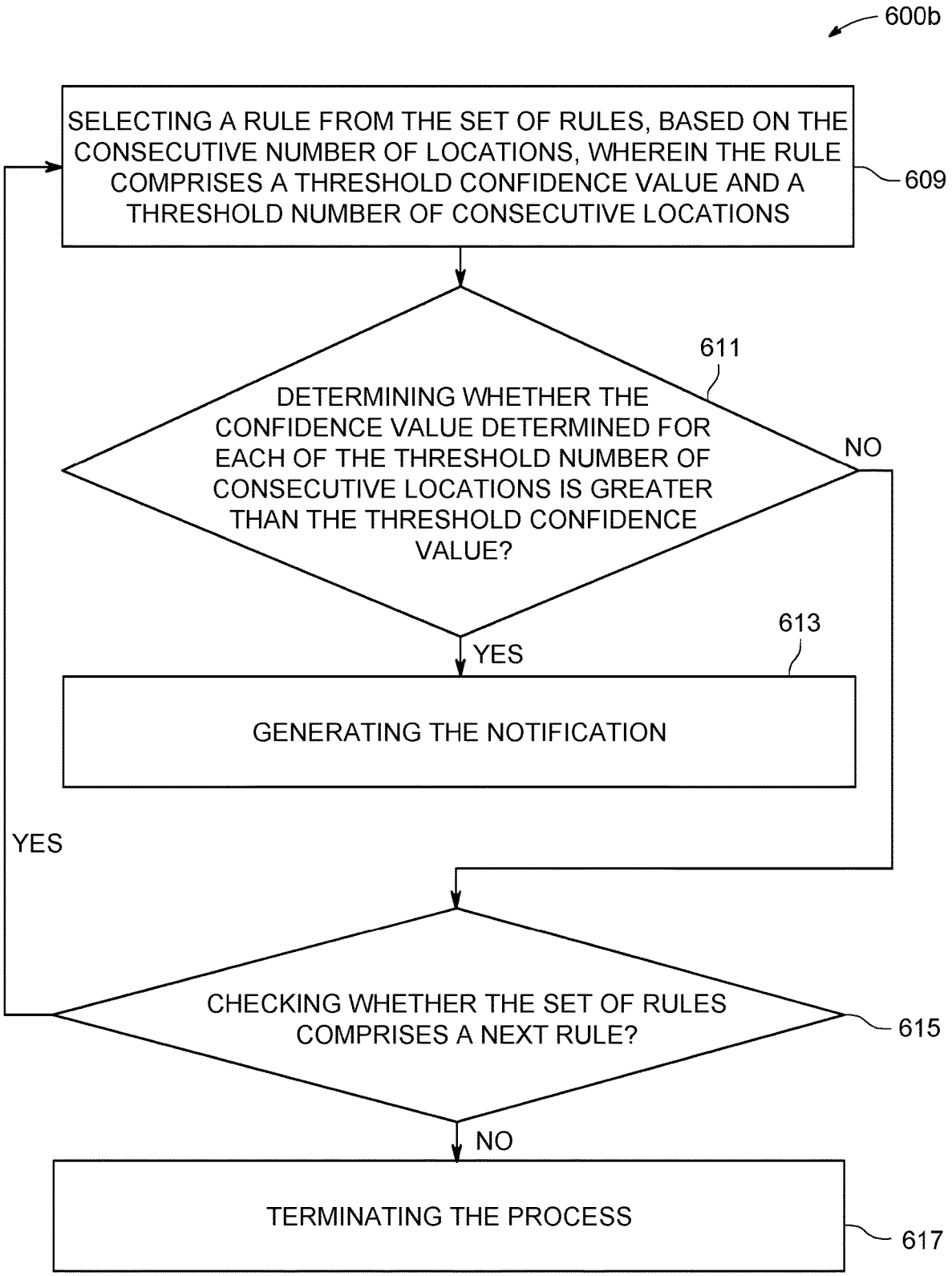

Having thus described example embodiments of the invention in general terms, reference will now be made to the accompanying drawings, which are not necessarily drawn to scale, and wherein:

FIG. 1 illustrates a block diagram showing an example architecture of a system for determining a driving direction, in accordance with one or more example embodiments;

FIG. 2 illustrates a block diagram of the system for determining the driving direction, in accordance with one or more example embodiments;

FIG. 3A illustrates an exemplary working environment of the system for determining the driving direction, in accordance with one or more example embodiments;

FIG. 3B illustrates a schematic diagram for determining the driving direction, in accordance with one or more example embodiments;

FIG. 3C illustrates a schematic diagram for generating a notification, in accordance with one or more example embodiments;

FIG. 4 illustrates an exemplary working environment of the system for determining the driving direction in a left-hand-side driving scenario, in accordance with one or more example embodiments;

FIG. 5 illustrates a graph for generating the notification, in accordance with one or more example embodiments;

FIG. 6A illustrates a flowchart depicting a method for determining the driving direction, in accordance with one or more example embodiments; and FIG. 6B illustrates a flowchart depicting a method for generating the notification, in accordance with one or more example embodiments.

DETAILED DESCRIPTION

In the following description, for purposes of explanation, numerous specific details are set forth in order to provide a thorough understanding of the present disclosure. It will be apparent, however, to one skilled in the art that the present disclosure may be practiced without these specific details. In other instances, apparatuses and methods are shown in block diagram form only in order to avoid obscuring the present disclosure.

Reference in this specification to "one embodiment" or "an embodiment" means that a particular feature, structure, or characteristic described in connection with the embodiment is included in at least one embodiment of the present disclosure. The appearance of the phrase "in one embodiment" in various places in the specification are not necessarily all referring to the same embodiment, nor are separate or alternative embodiments mutually exclusive of other embodiments. Further, the terms "a" and "an" herein do not denote a limitation of quantity, but rather denote the presence of at least one of the referenced items. Moreover, various features are described which may be exhibited by some embodiments and not by others. Similarly, various requirements are described which may be requirements for some embodiments but not for other embodiments.

Some embodiments of the present invention will now be described more fully hereinafter with reference to the accompanying drawings, in which some, but not all, embodiments of the invention are shown. Indeed, various embodiments of the invention may be embodied in many different forms and should not be construed as limited to the embodiments set forth herein; rather, these embodiments are provided so that this disclosure will satisfy applicable legal requirements. Like reference numerals refer to like elements throughout. As used herein, the terms "data," "content," "information," and similar terms may be used interchangeably to refer to data capable of being transmitted, received and/or stored in accordance with embodiments of the present invention. Thus, use of any such terms should not be taken to limit the spirit and scope of embodiments of the present invention.

Additionally, as used herein, the term 'circuitry' may refer to (a) hardware-only circuit implementations (for example, implementations in analog circuitry and/or digital circuitry); (b) combinations of circuits and computer program product(s) comprising software and/or firmware instructions stored on one or more computer readable memories that work together to cause an apparatus to perform one or more functions described herein; and (c) circuits, such as, for example, a microprocessor(s) or a portion of a microprocessor(s), that require software or firmware for operation even if the software or firmware is not physically present. This definition of 'circuitry' applies to all uses of this term herein, including in any claims. As a further example, as used herein, the term 'circuitry' also includes an implementation comprising one or more processors and/or portion(s) thereof and accompanying software and/or firmware. As another example, the term 'circuitry' as used herein also includes, for example, a baseband integrated circuit or applications processor integrated circuit for a mobile phone or a similar integrated circuit in a server, a cellular network device, other network device, and/or other computing device.

As defined herein, a "computer-readable storage medium," which refers to a non-transitory physical storage medium (for example, volatile or non-volatile memory device), may be differentiated from a "computer-readable transmission medium," which refers to an electromagnetic signal.

The embodiments are described herein for illustrative purposes and are subject to many variations. It is understood that various omissions and substitutions of equivalents are contemplated as circumstances may suggest or render expedient but are intended to cover the application or implementation without departing from the spirit or the scope of the present disclosure. Further, it is to be understood that the phraseology and terminology employed herein are for the purpose of the description and should not be regarded as limiting. Any heading utilized within this description is for convenience only and has no legal or limiting effect.

A system, a method, and a computer program product are provided for determining a driving direction. Various embodiments are provided herein for obtaining the sensor data associated with the vehicle. The sensor data associated with the vehicle may include at least location data of the vehicle and lateral position data of the vehicle. In various embodiments, the sensor data may be continuously obtained at a predefined frequency. In various embodiments, the lateral position data may correspond to distance data indicative of distance from centre of the vehicle to a boundary of a road segment and/or a link.

Various embodiments are provided for identifying the link associated with the sensor data, based on the location data and map data. In various embodiments, the link may be identified by map-matching the location data to the map data.

Various embodiments are provided for calculating half width data associated with the link, based on the lateral position data. In various embodiments, the half width data associated with the link may be calculated by determining a first lateral position data and a second lateral position data for the link. As used herein, the first lateral position data may correspond to distance data indicative of distance from the centre of the vehicle to a right boundary of the link. As used herein, the second lateral position data may correspond to distance data indicative of distance from the centre of the vehicle to a left boundary of the link.

Various embodiments are provided for determining the driving direction, based on the half width data, the lateral position data, and vehicle width data. In various embodiments, the driving direction may be determined as at least one of a right-way driving direction and a wrong-way driving direction by comparing a summation of the lateral position data and the vehicle width data with the half width data. In some embodiments, the driving direction may be determined by determining a confidence value based on the half width data, the lateral position data, and the vehicle width data.

Various embodiments are provided for generating a notification, based on the confidence value. In some example embodiments, the notification may be generated if the confidence value is close to one. In some other example embodiments, the notification may not be generated just by using one confidence value for a particular location of the vehicle, to address inconsistencies in GPS error, road geometries and the like. To that end, the notification may be generated by determining the confidence value for a plurality of locations associated with the vehicle. In various embodiments, the plurality of locations may be consecutive number of locations. Further, the generated notification may be provided to avoid the unwanted conditions such as road accidents (e.g., head-on collisions of vehicles), vehicle damages, fatalities, and the like.

FIG. 1 illustrates a block diagram 100 showing an example architecture of a system 101 for determining a driving direction, in accordance with one or more example embodiments. As illustrated in FIG. 1, the block diagram 100 may comprise the system 101, a network 103, and a mapping platform 105. The mapping platform 105 may further comprise a map database 105*a* (also referred to as a geographic database 105*a*) and a server 105*b*. In various embodiments, the system 101 may be onboard a vehicle, such as the system 101 may be a navigation system installed in the vehicle for determining the driving direction. In various embodiments, the vehicle may be an autonomous vehicle, a semiautonomous vehicle, or a manual vehicle. In some embodiments, the system 101 may be the server 105*b* of the mapping platform 105 and therefore may be co-located with or within the mapping platform 105. In some other embodiments, the system 101 may be an OEM (Original Equipment Manufacturer) cloud. The OEM cloud may be configured to anonymize any data received from the system 101, such as the vehicle, before using the data for further processing, such as before sending the data to the mapping platform 105. In some embodiments, anonymization of data may be done by the mapping platform 105. The system 101 may be communicatively coupled with the mapping platform 105 over the network 103.

The network 103 may be wired, wireless, or any combination of wired and wireless communication networks, such as cellular, Wi-Fi, internet, local area networks, or the like. In some embodiments, the network 103 may include one or more networks such as a data network, a wireless network, a telephony network, or any combination thereof. It is contemplated that the data network may be any local area network (LAN), metropolitan area network (MAN), wide area network (WAN), a public data network (e.g., the Internet), short range wireless network, or any other suitable packet-switched network, such as a commercially owned, proprietary packet-switched network, e.g., a proprietary cable or fiber-optic network, and the like, or any combination thereof. In addition, the wireless network may be, for example, a cellular network and may employ various technologies including enhanced data rates for global evolution (EDGE), general packet radio service (GPRS), global system for mobile communications (GSM), Internet protocol multimedia subsystem (IMS), universal mobile telecommunications system (UNITS), etc., as well as any other suitable wireless medium, e.g., worldwide interoperability for microwave access (WiMAX), Long Term Evolution (LTE) networks (for e.g. LTE-Advanced Pro), 5G New Radio networks, ITU-IMT 2020 networks, code division multiple access (CDMA), wideband code division multiple access (WCDMA), wireless fidelity (Wi-Fi), wireless LAN (WLAN), Bluetooth, Internet Protocol (IP) data casting, satellite, mobile ad-hoc network (MANET), and the like, or any combination thereof.

The system 101 may communicate with the mapping platform 105, via the network 103, where the mapping platform 105 may comprise the map database 105*a* for storing map data, and the processing server 105*b* for carrying out the processing functions associated with the mapping platform 105. The map database 105*a* may store node data, road segment data or link data, point of interest (POI) data, road obstacles related data, traffic objects related data, posted signs related data, such as road sign data, sensor data related to permissible driving directions, data about valid paths based on legally permissible road geometries or the like. The map database 105*a* may also include cartographic data and/or routing data. According to some example embodiments, the road segment data records may be links or segments representing roads, streets, or paths, as may be used in calculating a route or recorded route information for determination of one or more personalized routes. The node data may be end points corresponding to the respective links or segments of road segment data. For example, the node data may represent data for intersections. The road/link data and the node data may represent a road network, such as used by vehicles, for example, cars, trucks, buses, motorcycles, and/or other entities.

Optionally, the map database 105*a* may contain path segment and node data records or other data that may represent pedestrian paths or areas in addition to or instead of the vehicle road record data, for example. The road/link segments and nodes may be associated with attributes, such as geographic coordinates, lane data records and other navigation related attributes, as well as POIs, such as fueling stations, hotels, restaurants, museums, stadiums, offices, auto repair shops, buildings, stores, parks, etc. The lane data records may comprises data related a number of lanes on a particular link/road segment, a number of lanes for a particular link/road segment determined by visual inspection, and the like. Additionally, the lane data records may comprise legal travel directions (travel directions that the vehicles should follow while traveling on lanes of a particular link/road segment), lane level speed profile (historically derived speed limits for a lane), lane level maneuver pattern (lane change patterns at intersections), and the like. The map database 105*a* may include data about the POIs and their respective locations in the POI records. The map database 105*a* may additionally include data about places, such as cities, towns, or other communities, and other geographic features such as bodies of water, mountain ranges, etc. Such place or feature data may be part of the POI data or may be associated with POIs or POI data records (such as a data point used for displaying or representing a position of a city). In addition, the map database 105*a* may include event data (e.g., traffic incidents, construction activities, scheduled events, unscheduled events, etc.) associated with the POI data records or other records of the map database 105*a*. The map database 105*a* may additionally include data related to road signs, road obstacles, traffic objects and the like. The map database may be communicatively coupled to the processing server 105*b*.

In one embodiment, the map or geographic database 105*a* may be maintained by a content provider in association with the mapping platform 105 (e.g., a map developer). The map developer may collect geographic data to generate and enhance the geographic database 105*a*. There may be different ways used by the map developer to collect data. These ways may include obtaining data from other sources, such as municipalities or respective geographic authorities. In addition, the map developer may employ field personnel to travel by vehicle (e.g., vehicles and/or user terminals) along roads throughout the geographic region to observe features and/or record information about them, for example. Also, remote sensing, such as aerial or satellite photography, may be used.

The geographic database 105*a* may be a master geographic database stored in a format that facilitates updating, maintenance, and development. For example, the master geographic database or data in the master geographic database may be in an Oracle spatial format or other spatial format, such as for development or production purposes. The Oracle spatial format or development/production database may be compiled into a delivery format, such as a geographic data files (GDF) format. The data in the production and/or delivery formats may be compiled or further compiled to form geographic database products or databases, which may be used in end user navigation devices or systems.

For example, geographic data is compiled (such as into a platform specification format (PSF) format) to organize and/or configure the data for performing navigation-related functions and/or services, such as a wrong-way driving determination, route calculation, route guidance, map display, speed calculation, distance and travel time functions, and other functions, by a navigation device, such as by a vehicle or a user terminal, for example. The navigation-related functions may correspond to vehicle navigation, pedestrian navigation, or other types of navigation. The compilation to produce the end user databases may be performed by a party or entity separate from the map developer. For example, a customer of the map developer, such as a navigation device developer or other end user device developer, may perform compilation on a received geographic database in a delivery format to produce one or more compiled navigation databases.

The processing server 105*b* may comprise one or more processors configured to process requests received from the system 101. The processor may fetch map data from the map database 105*a* and transmit the same to the system 101 in a format suitable for use by the system 101. In some example embodiments, as disclosed in conjunction with the various embodiments disclosed herein, the system 101 may be used to determine the driving direction.

FIG. 2 illustrates a block diagram 200 of the system 101 for determining the driving direction, in accordance with one or more example embodiments. The system 101 may include at least one processor 201, a memory 203, and at least one communication interface 205. Further, the system 101 may comprise a sensor data reception module 201*a*, map-matching module 201*b*, lane detection module 201*c*, a driving direction determination module 201*d*, and a notification generation module 201*e*. In various embodiments, the sensor data reception module 201*a* may be configured to obtain sensor data associated with a vehicle. The sensor data may include at least location data of the vehicle and lateral position data of the vehicle. In various embodiments, the map-matching module 201*b* may be configured to identify a link associated with the sensor data, based on the location data and the map data obtained from the map database 105*a*. In various embodiments, the lane detection module 201*c* may be configured to calculate half width data associated with the link, based on the lateral position data. In various embodiments, the driving direction determination module 201*d* may be configured to determine the driving direction as at least one a right-way driving direction and a wrong-way driving direction, based on the half width data, the lateral position data, and vehicle width data. In various embodiments, the notification module 201*e* may be configured to generate the notification.

According to some embodiments, each of the modules 201*a*-201*e* may be embodied in the processor 201. The processor 201 may retrieve computer program code instructions that may be stored in the memory 203 for execution of computer program code instructions, which may be configured for determining the driving direction.

The processor 201 may be embodied in a number of different ways. For example, the processor 201 may be embodied as one or more of various hardware processing means such as a coprocessor, a microprocessor, a controller, a digital signal processor (DSP), a processing element with or without an accompanying DSP, or various other processing circuitry including integrated circuits such as, for example, an ASIC (application specific integrated circuit), an FPGA (field programmable gate array), a microcontroller unit (MCU), a hardware accelerator, a special-purpose computer chip, or the like. As such, in some embodiments, the processor 201 may include one or more processing cores configured to perform independently. A multi-core processor may enable multiprocessing within a single physical package. Additionally, or alternatively, the processor 201 may include one or more processors configured in tandem via the bus to enable independent execution of instructions, pipelining and/or multithreading.

Additionally, or alternatively, the processor 201 may include one or more processors capable of processing large volumes of workloads and operations to provide support for big data analysis. In an example embodiment, the processor 201 may be in communication with a memory 203 via a bus for passing information to mapping platform 105. The memory 203 may be non-transitory and may include, for example, one or more volatile and/or non-volatile memories. In other words, for example, the memory 203 may be an electronic storage device (for example, a computer readable storage medium) comprising gates configured to store data (for example, bits) that may be retrievable by a machine (for example, a computing device like the processor 201). The memory 203 may be configured to store information, data, content, applications, instructions, or the like, for enabling the system 101 to carry out various functions in accordance with an example embodiment of the present invention. For example, the memory 203 may be configured to buffer input data for processing by the processor 201. As exemplarily illustrated in FIG. 2, the memory 203 may be configured to store instructions for execution by the processor 201. As such, whether configured by hardware or software methods, or by a combination thereof, the processor 201 may represent an entity (for example, physically embodied in circuitry) capable of performing operations according to an embodiment of the present invention while configured accordingly. Thus, for example, when the processor 201 is embodied as an ASIC, FPGA or the like, the processor 201 may be specifically configured hardware for conducting the operations described herein. Alternatively, as another example, when the processor 201 is embodied as an executor of software instructions, the instructions may specifically configure the processor 201 to perform the algorithms and/or operations described herein when the instructions are executed. However, in some cases, the processor 201 may be a processor specific device (for example, a mobile terminal or a fixed computing device) configured to employ an embodiment of the present invention by further configuration of the processor 201 by instructions for performing the algorithms and/or operations described herein. The processor 201 may include, among other things, a clock, an arithmetic logic unit (ALU) and logic gates configured to support operation of the processor 201.

In some embodiments, the processor 201 may be configured to provide Internet-of-Things (IoT) related capabilities to users of the system 101, where the users may be a traveler, a driver of the vehicle and the like. In some embodiments, the users may be or correspond to an autonomous or semi-autonomous vehicle. The IoT related capabilities may in turn be used to provide smart navigation solutions by providing real time updates to the users to take pro-active decision on wrong way driving determination, speed determination, lane-level speed determination, turn-maneuvers, lane changes, overtaking, merging and the like, big data analysis, and sensor-based data collection by using the cloud based mapping system for providing navigation recommendation services to the users. The system 101 may be accessed using the communication interface 205. The communication interface 205 may provide an interface for accessing various features and data stored in the system 101. For example, the communication interface 205 may comprise I/O interface which may be in the form of a GUI, a touch interface, a voice enabled interface, a keypad, and the like. For example, the communication interface 205 may be a touch enabled interface of a navigation device installed in a vehicle, which may also display various navigation related data to the user of the vehicle. Such navigation related data may include information about upcoming conditions on a route, route display, alerts about vehicle speed, user assistance while wrong way driving, and the like.

FIG. 3A illustrates an exemplary working environment 300*a* of the system 101 for determining the driving direction, in accordance with one or more example embodiments. As illustrated in FIG. 3A, the working environment 300*a* includes the system 101, the network 103, the mapping platform 105, a vehicle 301, a driving direction 303 associated with the vehicle 301, and a link 305. As used herein, the 'link' 305 may be a road segment between two nodes (each node may represent an intersection). In various embodiments, the link 305 may be a bidirectional link. For instance, the link 305 may comprise lanes having opposite travel directions. In other words, the link 305 may be the road segment that comprises one or more 'TO' direction lanes and one or more 'FROM' direction lanes. To that end, the link 305 may comprise a plurality of lanes. For instance, the link 305 may comprise four lanes, a first lane 305*a*, a second lane 305*b*, a third lane 305*c*, and a fourth lane 305*d*, as illustrated in FIG. 3A. Further, each of the plurality of lanes may be associated with a travel direction. For instance, a first travel direction 307*a* may be associated with the first lane 305*a*, a second travel direction 307*b* may be associated with the second lane 305*b*, a third travel direction 307*c* may be associated with the third lane 305*c*, and a fourth travel direction 307*d* may be associated with the fourth lane 305*d*. As used herein, the 'travel direction' (e.g., the first travel direction 307*a*, the second travel direction 307*b*, the third travel direction 307*c*, the fourth travel direction 307*d*) may be a legal travel direction that the vehicle 301 should follow while traveling on a particular lane.

The vehicle 301 may include a motor vehicle, a non-motor vehicle, an automobile, a car, a scooter, a truck, a van, a bus, a motorcycle, a bicycle, a Segway, and/or the like. The vehicle 301 may be an autonomous vehicle, a semiautonomous vehicle, or a manual vehicle. As used herein, the autonomous vehicle may be a vehicle that is capable of sensing its environment and operating without human involvement. For instance, the autonomous may be a self-driving car and the like. Some embodiments are based on realization that if the driving direction 303 of the vehicle 301 matches with the travel direction (e.g., the second travel direction 307*b*) associated with a candidate lane (e.g., the second lane 305*b*) while the vehicle 301 is traveling on the candidate lane, the driving direction 303 associated with the vehicle 301 may be determined as a right-way driving direction. If the driving direction 303 of the vehicle 301 does not matches with the travel direction associated with the candidate lane while the vehicle 301 is traveling on the candidate lane, the driving direction 303 associated with the vehicle 301 may be determined as a wrong-way driving direction. As used herein, the driving direction 303 may indicate a direction in which the vehicle 301 is traveling. As used herein, the right-way driving direction may indicate that the vehicle 301 is traveling in the legal travel direction. As used herein, the wrong-way driving direction may indicate that the vehicle 301 is not traveling in the legal travel direction.

In many cases, the vehicle 301 may end-up traveling in the wrong-way driving direction, due to complex road geometries, to negotiate road hazards, and the like. For instance, even if the vehicle 301 is traveling in the right-way driving direction (for instance, if the vehicle 301 is traveling on the third lane 305*c* in the driving direction 303), in some cases, the vehicle 301 may change its lane (e.g., enter the second lane 305*b*) for a safe over-taking and the like. Further, if the vehicle 301 is traveling in the wrong-way driving direction and/or continues to travel in the wrong-way driving direction for a period time, the vehicle 301 may end-up with unwanted conditions such as road accidents (e.g., head-on collisions of vehicles), vehicle damages, fatalities, and the like.

To that end, the system 101 is provided to accurately determine the driving direction 303 as at least one of the right-way driving direction and wrong-way driving direction and to generate a notification based on the determination of the driving direction 303 such that the unwanted conditions are avoided. Further, the system 101 configured to determine the driving direction 303 as at least one of the right-way driving direction and wrong-way driving direction is as explained in the detailed description of FIG. 3B.

FIG. 3B illustrates a schematic diagram 300*b* for determining the driving direction 303 as at least one of the right-way driving direction and wrong-way driving direction, in accordance with one or more example embodiments. In various embodiments, the vehicle 301 may be equipped with various sensors for generating or collecting sensor data. For instance, the sensors of the vehicle 301 may include a radar system, a LiDAR system, a global positioning sensor for gathering location data (e.g., GPS coordinates), temporal information sensors, orientation sensors augmented with height sensors, tilt sensors, image sensors, and the like. In some example embodiments, the sensor data may be generated and reported to the system 101, at a predefined frequency. For instance, the predefined frequency may be as high as one hertz, based on the capabilities of the sensors.

In various embodiments, the system 101 may be configured to obtain the sensor data associated with the vehicle 301. For instance, the sensor data reception module 201*a* may obtain the sensor data associated with the vehicle 301. In various embodiments, the sensor data may comprise location data of the vehicle 301 and lateral position data of the vehicle 301. Additionally, the sensor data may comprise the driving direction 303, timestamp data, and the like. The timestamp data may comprise a time instance at which the sensor data was reported. In various embodiments, the lateral position data may comprise distance data indicative of a distance from center of the vehicle 301 to an edge of the link 305 (or a boundary of the link 305). In some example embodiments, the lateral position data may be obtained with a sign, for instance, either of a positive sign or a negative sign. The lateral position data with the positive sign may indicate the distance from center of the vehicle 301 to a right edge of the link 305 (or a right boundary of the link 305). Hereinafter, the lateral position data with the positive sign may be referred to as a first lateral position data 309. The lateral position data with the negative sign may indicate the distance from center of the vehicle 301 to a left edge of the link 305 (or a left boundary of the link 305). Hereinafter, the lateral position data with the negative sign may be referred to as a second lateral position data 311. In some example embodiments, the system 101 may obtain the lateral position data as at least one of the first lateral position 309, the second lateral position data 311, or a combination thereof.

In various embodiments, the system 101 may be configured to identify the link 305 associated with the sensor data, based on the location data and the map data obtained from the map database 105*a*. For instance, the map-matching module 201*b* may be configured to identify the link 305 associated with the sensor data, based on the location data and the map data obtained from the map database 105*a*. In some example embodiments, the system 101 may map-match the location data with the map data to identify the link 305.

In various embodiments, the system 101 may be configured to calculate half width data 313 associated with the link 305, based on the lateral position data. For instance, the lane detection module 201*c* may be configured to calculate the half width data 313 associated with the link 305, based on the lateral position data. In some example embodiments, the sensor data comprise at least one of the first lateral position data 309 or the second lateral position data 311. To that end, the system 101 may be configured to map-match the location data to the link 305, using the driving direction 303 and at least one of the first lateral position data 309 or the second lateral position data 311; and determine the first lateral position data 309 and the second lateral position data 311. Further, the system 101 may use the first lateral position data 309 and the second lateral position data 311 to calculate the half width data 313 associated with the link 305. In some embodiments, the system 101 may determine a difference between the first lateral position data 309 and the second lateral position data 311; compute an absolute of the difference; and divide the absolute value by two to calculate the half width data 313. For instance, the half width data 313 may be mathematically calculated as $$\frac{|\text{first lateral position data} - \text{second lateral position data}|}{2}.$$

In some other example embodiments, the sensor data may comprise the first lateral position data 309 and the second lateral position data 311. To that end, the system 101 may be configured to calculate the half width data 313 using the first lateral position data 309 and the second lateral position data 311 obtained from the sensor data.

In some embodiments, the system 101 may be configured to calculate width data 315 associated with the link 305, based on at least one of the lateral position data and the half width data 313. For instance, the lane detection module 201*c* may be configured to calculate the width data 315 associated with the link 305. In some embodiments, the system 101 may determine the difference between the first lateral position data 309 and the second lateral position data 311 and compute the absolute of the difference to calculate the width data 315. For instance, the width data 315 may be mathematically calculated as |first lateral position data−second lateral position data|.

In various embodiments, the system 101 may be configured to determine a number of lanes on the link 305, based on at least one of the half width data 313, the width data 315, and a threshold lane width. For instance, the lane detection module 201*c* may be configured to determine the number of lanes on the link 305. The threshold lane width may be associated with the link 305 as a map attribute, which may vary based on the link 305, a region in which the link 305 is located and the like. For instance, the threshold lane width may be 4.1 meter. For instance, the number of lanes on the link 305 may be mathematically calculated as $$\frac{\text{width data}}{4.1}.$$

In various embodiments, the system 101 may be configured to compare the determined number of lanes on the link 305 with ground truth data associated with the link 305. For instance, the lane detection module 201*c* may be configured to compare the determined number of lanes on the link 305 with the ground truth data associated with the link 305. For instance, the system 101 may obtain the ground truth data (e.g., the lane data record) associated with the link 305; and may compare the determined number of lanes on the link 305 with the ground truth data. The ground truth data may comprise a number of lanes on the link 305 and/or a number of lanes of the link 305 determined by visual inspection, dedicated vehicles, probe vehicles and the like. If the determined number of lanes on the link 305 matches with the ground truth data, the system 101 may validate the link 305 as a valid link. For instance, if a difference between the determined number of lanes on the link 305 and the ground truth data is close to '0', then the system 101 may validate the link 305 as the valid link. If the determined number of lanes on the link 305 does not match with the ground truth data, the system 101 may identify the link 305 as an invalid link. For instance, the link validation may be performed to confirm that the lane detection module 201*c* accurately calculates the half width data 313 and/or the width data 315. In some example embodiments, the lane detection module 201*c* may be further configured to determine, from the plurality of lanes 305*a*-305*d*, a lane in which the vehicle 301 is traveling.

In various embodiments, the system 101 may be configured to determine, for the vehicle 301, the driving direction 303 as at least one the right-way driving direction and the wrong-way driving direction, based on the half width data 313, the lateral position data, and vehicle width data. For instance, the driving direction determination module 201*d* may determine, for the vehicle 301, the driving direction 303 as at least one the right-way driving direction and the wrong-way driving direction, based on the half width data 313, the lateral position data, and the vehicle width data. The vehicle width data may indicate at least one of a width of the vehicle 301 and a half width of the vehicle 301. In some embodiments, the system 101 may compute a combination data using the lateral position data and the vehicle width data. In some example embodiments, the combination data may be a summation of the lateral position data and the vehicle width data or the vehicle half width data. For instance, the combination data may be mathematically computed as $$|\text{second lateral position data}| + \frac{\text{vehicle width data}}{2}.$$

In various embodiments, the system 101 may compare the half width data 313 with the combination data. For instance, the driving direction determination module 201*d* may compare the half width data 313 with the combination data. In some embodiments, the system 101 may check whether the half width data 313 is greater than the combination data. For instance, the comparison between the half width data 313 and the combination data may be mathematically represented as $$\text{half width data} > \left(|\text{second lateral position data}| + \frac{\text{vehicle width data}}{2}\right).$$

If the half width data 313 is greater than the combination data, the system 101 may determine the driving direction 303 as the wrong-way driving direction. If the half width data 313 is not greater than the combination data, the system 101 may determine the driving direction 303 as the right-way driving direction. Here for the purpose of explanation, the lateral position data is considered as the second lateral position data 311. For instance, the lateral position data may be the first lateral position data 309. When the lateral position data corresponds to the first lateral position data 309, the comparison between the half width data 313 and the combination data may be mathematically represented as $$\text{half width data} < \left(|\text{first lateral position data}| + \frac{\text{vehicle width data}}{2}\right).$$

In various embodiments, the system 101 may be further configured to determine a confidence value, based on the half width data 313, the lateral position data, and vehicle width data. For instance, the driving direction determination module 201*d* may determine the confidence value, based on at least one of the half width data 313, the lateral position data, and vehicle width data or a combination thereof. In various embodiments, the confidence value may be determined by executing an exponential function of the half width data 313, the lateral position data, and vehicle width data. For instance, the exponential function may be mathematically represented as $$1 - \frac{1}{e^{(x)}}.$$

The notation e' may be a Euler's constant. The Euler's constant may be chosen for its decay characteristics and its exponential nature. For instance, the Euler's constant may be '2.718'. The notation 'x' may be obtained by subtracting the lateral position data and the vehicle width data from the half width data 313. The notation 'x' may be mathematically represented as $$\left(\text{half width data} - |\text{lateral position data}| - \frac{\text{vehicle width data}}{2}\right).$$

In various embodiments, the confidence value may be determined as a value between '0' to '1'. If the confidence value is close to '1', the system 101 may determine the driving direction 303 as the wrong-way driving. If the confidence value is close to '0', the system 101 may determine the driving direction 303 as the right-way driving.

In various embodiments, the system 101 may be configured to generate a notification, based on the confidence value. For instance, the notification generation module 201*e* may generate the notification, based on the confidence value. In some example embodiments, the system 101 may generate the notification if the confidence value is close to '1'. The notification may include at least one of an alert message indicative of the wrong-way driving, an audio message indicating the wrong-way driving, a visual message indicating the wrong-way driving, and a navigation instruction related to the wrong-way driving. In some other example embodiments, the system 101 may not generate the notification by using the confidence value determined for one particular location (e.g., GPS coordinates), due to GPS error (e.g., GPS fluctuations) and/or road geometries (e.g., short maneuvers, and the like). To that end, the system 101 may be configured to determine, for a period of time, the driving direction 303 as at least one of the right-way driving direction and the wrong-way driving direction and may be configured to generate the notification based on the driving direction 303 determined for the period of time, so that driving direction data for a consecutive number of locations is obtained during that period of time. In other words, the system 101 may generate the notification after determining the confidence value for a consecutive number of locations associated with the vehicle 301. Further, the system 101 configured to generate the notification after determining the confidence value for the consecutive number of locations is as explained in the detailed description of FIG. 3C.

FIG. 3C illustrates a schematic diagram 300*c* for generating the notification, in accordance with one or more example embodiments. In various embodiments, the system 101 may be configured to obtain the sensor data for a plurality of locations 317. In some embodiments, the plurality of locations 317 may be consecutive locations associated with the vehicle 301. The sensor data associated with each of the plurality of locations 317 may comprise the location data of the vehicle 301 and the lateral position data of the vehicle 301. In various embodiments, the system 101 may be configured to identify the link 305 associated with the sensor data, based on the lateral position data associated with each of the plurality of locations 317. For instance, the system 101 may identify the link 305 for each of the plurality of locations 317 as explained in the detailed description of FIG. 3B. In various embodiments, the system 101 may be configured to calculate the half width data 313 associated with the link 305, based on the lateral position data associated with each of the plurality of locations 317. For instance, the system 101 may calculate, for each of the plurality of locations 317, the half width data 313 associated with the link 305 as explained in the detailed description of FIG. 3B. In various embodiments, the system 101 may be configured to determine the confidence value for each of the plurality of locations 317, based on the half width data 313, the lateral position data associated with each of the plurality of locations 317, and the vehicle width data. For instance, the system 101 may determine the confidence value for each of the plurality of locations 317 as explained in the detailed description of FIG. 3B.

In various embodiments, the system 101 may be configured to generate the notification, based on the confidence value for each of the plurality of locations 317 and a set of rules. In various embodiments, the set of rules may provide at least one threshold confidence value and at least one threshold number of consecutive locations. For instance, the set of rules may be represented as a set (e.g., a list, a tuple, or the like) comprising a plurality of rules, for example, set of rules={a first rule, a second rule, a third rule, a fourth rule, and so on}. The first rule may comprise a first threshold confidence value (e.g., the first threshold confidence value=0.65) and a first threshold number of consecutive locations (e.g., the first threshold number of consecutive locations=4). The second rule may comprise a second threshold confidence value (e.g., the second threshold confidence value=0.60) and a second threshold number of consecutive locations (e.g., the second threshold number of consecutive locations=6). The third rule may comprise a third threshold confidence value (e.g., the third threshold confidence value=0.55) and a third threshold number of consecutive locations (e.g., the third threshold number of consecutive locations=8). The fourth rule may comprise a fourth threshold confidence value (e.g., the fourth threshold confidence value=0.50) and a fourth threshold number of consecutive locations (e.g., the fourth threshold number of consecutive locations=10).

To that end, each rule in the set of rules may comprise the threshold confidence value and the threshold number of consecutive locations. The set of rules may be stored on the memory 203 and/or may be obtained from the map database 105*a*. For generating the notification, the system 101 may select a rule from the set of rules, based on the plurality of locations 317 (e.g., the consecutive number of locations). In some embodiments, the system 101 may select the rule from the set of rules, when a number of the plurality of locations 317 matches with the threshold number of consecutive locations of the rule and if the plurality of locations 317 are the consecutive number of locations associated with the vehicle 301. In some example embodiments, the system 101 may be configured as a counter to ensure the plurality of locations 317 are the consecutive number of locations associated with the vehicle 301. The counter may increment, for each location of the plurality of locations 317, a counter value by '1' if the driving direction 303 for a respective location is determined as the wrong way driving. The counter may reset the counter value if the driving direction 303 is determined as the right-way driving. To that end, the system 101 may ensure that the plurality of locations 317 are the consecutive number of locations that are determined as the wrong way driving direction. Further, the system 101 may check, from the set of rules, the rule that comprises the threshold number of consecutive locations that matches with the counter value (i.e., the consecutive number of the locations that are determined as the wrong way driving direction). For instance, the system 101 may select the first rule from the set of rules, as the plurality of locations 317 are the consecutive number of locations that are determined as the wrong way driving direction and the number of plurality of locations 317 matches the first threshold number of consecutive locations.

In various embodiments, the system 101 may be configured to determine whether the confidence value determined for each of the plurality of locations 317 (or the first threshold number of consecutive locations) is greater than the first threshold confidence value. For instance, the system 101 may determine whether the confidence value determined for each of first four locations is greater than the first threshold confidence value (e.g., the first threshold confidence value=0.65). If the confidence value determined for at least one of the plurality of locations 317 (or the first threshold number of consecutive locations) is not greater than the first threshold confidence value, the system 101 may select the second rule from the set of rules.

In various embodiments, the system 101 may be configured to determine whether the confidence value determined for each of the second threshold number of consecutive locations is greater than the second threshold confidence value. For instance, the system 101 may determine whether the confidence value determined for each of first six locations is greater than the second threshold confidence value (e.g., the second threshold confidence value=0.60). If the confidence value determined for at least one of the second threshold number of consecutive locations is not greater than the second threshold confidence value, the system 101 may select the third rule from the set of rules.

Similarly, the system 101 may determine whether the confidence value determined for each of the third threshold number of consecutive locations is greater than the third threshold confidence value. For instance, the system 101 may determine whether the confidence value determined for each of first eight locations is greater than the third threshold confidence value (e.g., the third threshold confidence value=0.55). If the confidence value determined for at least one of the third threshold number of consecutive locations is not greater than the third threshold confidence value, the system 101 may select the fourth rule from the set of rules. In this way, the system 101 may check with each rule in the set of rules for generating the notification.

In various embodiments, the system 101 may generate the notification, when at least one rule in the set of rules is satisfied. For instance, the system 101 may generate the notification, in response to at least one of: determining the confidence value determined for each of the first threshold number of consecutive locations is greater than the first threshold confidence value; determining the confidence value determined for each of the second threshold number of consecutive locations is greater than the second threshold confidence value; determining the confidence value determined for each of the third threshold number of consecutive locations is greater than the third threshold confidence value; and/or determining the confidence value determined for each of the fourth threshold number of consecutive locations is greater than the fourth threshold confidence value.

In some other example embodiments, the system 101 may execute a distribution function for generating the notification. In various embodiments, the distribution function may be based on the set of rules. For instance, the distribution function may be mathematically represented as notification=ln(consective number of locations)+confidence value−intercept, where 'intercept' may be a constant. In various embodiments, the notification may be at least one of the alert message indicative of the wrong-way driving, the audio message indicating the wrong-way driving, the visual message indicating the wrong-way driving, and the navigation instruction related to the wrong-way driving. Additionally, in some embodiments, the notification may be at least one control signal to switch the vehicle 301 from an automatic mode to a manual model and/or to control the vehicle 301 to move in the right-way driving direction, and the like.

In this way, the system 101 may accurately determine the driving direction 303 as at least one of the right-way driving direction and the wrong-way direction and generate the notification such that the unwanted conditions such as road accidents (e.g., head-on collisions of vehicles), vehicle damages, fatalities, and the like are avoided. Further, the system 101 may use the generated notification to assist the vehicle 301 and/or a driver of the vehicle 301 to take decision on real-time. Here for the purpose of explanation, right-hand-side driving scenarios are considered. For instance, the system 101 may also determine, in left-had side driving scenarios, the driving direction 303 as at least one of the right-way driving direction and the wrong-way direction. Further, the system 101 configured to determine the driving direction as at least one of the right-way driving direction and the wrong-way direction in left-hand-side driving scenarios is as explained in the detailed description of FIG. 4.

FIG. 4 illustrates an exemplary working environment 400*a* of the system 101 for determining the driving direction, in accordance with one or more example embodiments. The working environment 400*a* illustrates the left-hand-side driving scenario. As illustrated in FIG. 4, the working environment 400*a* includes the system 101, the network 103, the mapping platform 105, a vehicle 401, a driving direction 403 associated with the vehicle 401, and a link 405. The driving direction 403 may be a direction (also referred to as heading direction) in which the vehicle 401 is traveling. The link 405 may be a road segment between two nodes. The link 405 may comprise a first lane 405*a*, a second lane 405*b*, a third lane 405*c*, and a fourth lane 405*d*. In various embodiments, each of the lanes (e.g., 405*a*-405*d*) may be associated with the travel direction. For instance, the first lane 405*a* may be associated with a first travel direction 407*a*, the second lane 405*b* may be associated with a second travel direction 407*b*, the third lane 405*c* may be associated with a third travel direction 407*c*, and the fourth lane 405*d* may be associated with a fourth travel direction 407*d*.

The system 101 may be configured to obtain the sensor data associated with the vehicle 401. The sensor data may comprise at least the location data of the vehicle 401, and the lateral position data of the vehicle 401 as explained in the detailed description of FIG. 3B. The system 101 may be configured to identify the link 405 associated with the sensor data, based on the location data of the vehicle 401 and the map data obtained from the map database 105*a*. For instance, the system 101 may identify the link 405 as explained in the detailed description of FIG. 3B. The system 101 may be configured to calculate at least one of a half width data 409 and a width data 411 associated with the link 405, based on the lateral position data. For instance, the system 101 may calculate at least one of the half width data 409 and the width data 411 as explained detailed description of FIG. 3B.

The system 101 may be configured to determining the driving direction 403 as at least one of the right-way driving direction and the wrong-way driving direction, based on the half width data 409, the lateral position data, the vehicle width data. In various embodiments, the lateral position data may comprises at least one the first lateral position data and the second lateral position data as explained in the detailed description of FIG. 3B. The vehicle width data may correspond to a width of the vehicle 401. In some embodiments, the system 101 may determine the driving direction 403 as the wrong-way driving direction, when a left-hand-side driving condition is satisfied. In some example embodiments, the left-hand-side driving condition may be $$\text{half width data} < \left(|\text{second lateral position data}| + \frac{\text{vehicle width data}}{2}\right).$$

In some other example embodiments, the left-hand-side driving condition may be $$\text{half width data} > \left(|\text{first lateral position data}| + \frac{\text{vehicle width data}}{2}\right).$$

The system 101 may determine the confidence value, based on the half width data 409, the lateral position data, and the vehicle width data. For instance, the system 101 may determine the confidence value as explained in the detailed description of FIG. 3B. Further, the system 101 may generate the notification, based on the confidence value, a consecutive number of locations associated with the vehicle 401, and the set of rules. For instance, the system 101 may generate the notification as explained in the detailed description of FIG. 3C.

In this way, the system 101 may accurately determine, in the left-hand-side driving scenario, the driving direction 403 as at least one of the right-way driving direction and the wrong-way direction and generate the notification such that the unwanted conditions such as road accidents (e.g., head-on collisions of vehicles), vehicle damages, fatalities, and the like are avoided. Further, a graph for generating the notification in at least one of the right-hand-side driving scenario and the left-hand-side driving scenario is as explained in the detailed description of FIG. 5.

FIG. 5 illustrates a graph 500 for generating the notification, in accordance with one or more example embodiments. In the graph 500, x-axis may correspond to the consecutive number of locations of the vehicle. For instance, the x-axis of the graph 500 may correspond to the counter value. In the graph 500, y-axis may correspond to the confidence value. The graph 500 is based on data points 501. The data points 501 may correspond to the set of rules. The graph 500 illustrates that the system 101 may uses a smaller number of consecutive locations to generate the notification, as the confidence value increases. In other words, the system 101 may generate the notification in short amount time if the confidence value is high. Further, the graph 500 may be mathematically represented as notification=ln(x)+y−intercept, where 'x' is the consecutive number of locations associated with the vehicle, 'y' is the confidence value, and 'intercept' is a constant.

FIG. 6A illustrates a flowchart depicting a method 600*a* for determining the driving direction, in accordance with one or more example embodiments. It will be understood that each block of the flow diagram of the method 600*a* may be implemented by various means, such as hardware, firmware, processor, circuitry, and/or other communication devices associated with execution of software including one or more computer program instructions. For example, one or more of the procedures described above may be embodied by computer program instructions. In this regard, the computer program instructions which embody the procedures described above may be stored by the memory 203 of the system 101, employing an embodiment of the present invention and executed by the processor 201. As will be appreciated, any such computer program instructions may be loaded onto a computer or other programmable apparatus (for example, hardware) to produce a machine, such that the resulting computer or other programmable apparatus implements the functions specified in the flow diagram blocks. These computer program instructions may also be stored in a computer-readable memory that may direct a computer or other programmable apparatus to function in a particular manner, such that the instructions stored in the computer-readable memory produce an article of manufacture the execution of which implements the function specified in the flowchart blocks. The computer program instructions may also be loaded onto a computer or other programmable apparatus to cause a series of operations to be performed on the computer or other programmable apparatus to produce a computer-implemented process such that the instructions which execute on the computer or other programmable apparatus provide operations for implementing the functions specified in the flow diagram blocks.

Accordingly, blocks of the flow diagram 600*a* support combinations of means for performing the specified functions and combinations of operations for performing the specified functions for performing the specified functions. It will also be understood that one or more blocks of the flow diagram, and combinations of blocks in the flow diagram, may be implemented by special purpose hardware-based computer systems which perform the specified functions, or combinations of special purpose hardware and computer instructions.

Starting at block 601, the method 600*a* may include obtaining the sensor data associated with the vehicle 301. For instance, the sensor data reception module 201*a* may obtain the sensor data associated with the vehicle 301. The sensor data may comprise at least the location data of the vehicle 301 and the lateral position data of the vehicle 301 as explained in the detailed description of FIG. 3B.

At block 603, the method 600*a* may include identifying the link 305 associated with the sensor data, based on the location data and the map data obtained from the map database 105*a*. For instance, the map-matching module 201*b* may map-match the location data and the map data to identify the link 305 associated with the sensor data.

At block 605, the method 600*a* may include calculating the half width data 313 associated with the link 305, based on the lateral position data. For instance, the lane detection module 201*c* may calculate the half width data 313 associated with the link 305 as explained in the detailed description of FIG. 3B. Further, in some example embodiments, the lane detection module 201*c* may determine the number of lanes on the link 305 based on the half width data 313; and validate the link 405, based on the number of lanes on the link 305 and the ground truth data associated with the link 305.

At block 607, the method 600*a* may include determining the driving direction 303 for the vehicle 301, based on the half width data 313, the lateral position data and the vehicle width data. For instance, the driving direction determination module 201*d* may determine the driving direction 303 as at last one of the right-way driving direction and the wrong-way driving direction, based on the half width data 313, the lateral position data and the vehicle width data. At block 607, in some embodiments, the method 600*a* may include determining the confidence value, based on the half width data 313, the lateral position data and the vehicle width data. Further, the method 600*a* may include determining the driving direction 303 for the vehicle 301, based on the confidence value. In some embodiments, if the confidence value is close to '1', the driving direction determination module 201*d* may determine the driving direction 303 as the wrong-way driving direction. In some embodiments, if the confidence value is close to '0', the driving direction determination module 201*d* may determine the driving direction 303 as the right-way driving direction. Furthermore, in some embodiments, the system 101 may use the determined driving direction to generate the notification. In some example embodiments, the notification may be generated after determining the confidence value for the consecutive number of locations (e.g., the plurality of locations 317) to address inconsistencies in the location data, the road geometry, and the like. Further, a method for generating the notification, based on the confidence value determined for the consecutive number of locations is as explained in the detailed description of FIG. 6B.

FIG. 6B illustrates a flowchart depicting a method 600*b* for generating the notification, in accordance with one or more example embodiments. The method 600*b* may be used in conjunction with the system 101 described in the detailed description of FIG. 3A-FIG. 3C. Although various steps of method 600*b* are described below and depicted in FIG. 6B, the steps need not necessarily all be performed, and in some cases may be performed in a different order than the order shown.

Starting at block 609, the method 600*b* may include selecting the rule from the set of rules, based on the consecutive number of locations. For instance, the notification generation module 201*e* may select the rule from the set of rules, based on the consecutive number of locations. Each rule in the set of rules comprises the threshold confidence value and the threshold number of consecutive locations. To that end, the notification generation module 201*e* may select, from the set of rules, the rule (e.g., the first rule) that comprise the threshold number of consecutive locations that matches the consecutive number of locations.

At block 611, the method 600*b* may include determining whether the confidence value determined for each of the threshold number of consecutive locations is greater than the threshold confidence value. For instance, the notification generation module 201*e* may determining whether the confidence value determined for each of the threshold number of consecutive locations is greater than the threshold confidence value. If the confidence value determined for each of the threshold number of consecutive locations is greater than the threshold confidence value, the method 600*b* may proceed with block 613.

At block 613, the method 600*b* may include generating the notification. For instance, the notification generation module 201*e* may generate the notification. The notification may be at least one of the alert message indicative of the wrong-way driving, the audio message indicating the wrong-way driving, the visual message indicating the wrong-way driving, and the navigation instruction related to the wrong-way driving. Additionally, in some embodiments, the notification may be at least one control signal to switch the vehicle 301 from an automatic mode to a manual model and/or to control the vehicle 301 to move in the right-way driving direction, and the like.

If the confidence value determined for at least one of the threshold number of consecutive locations is not greater than the threshold confidence value, the method 600*b* may proceed with block 615.

At block 615, the method 600*b* may include checking whether the set of rules comprises a next rule. For instance, the notification generation module 201*e* may check whether the set of rules comprises the next rule. In other words, the notification generation module 201*e* may check whether the set (e.g., a list, a tuple, or the like) comprises an element (e.g., the second rule, or the like) that is subsequent to the previously selected element (e.g., the previously selected first rule, or the like). If the set of rules comprises the next rule (e.g., the second rule), the method 600*b* may proceed with block 609. At block 609, the method 600*b* may include selecting the next rule. Further, the method 600*b* may proceed with the blocks 611 and 613 for generating the notification. In this way, the method 600*b* may be iteratively performed until generating the notification and/or until all the rules in the set of rules are checked. If the set of rules does not comprise the next rule, the method 600*b* may proceed with block 617. At block 617, the method 600*b* may include terminating the process.

On implementing the methods 600*a* and 600*b* disclosed herein, the system 101 may be configured to accurately determine the driving direction as at least one of right-way driving direction and the wrong-way driving direction and further the system 101 may generate the notification such that the unwanted conditions such as the road accidents, the head-on collisions of vehicles, the fatalities and the like are avoided.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

We claim:

1. A system for determining a driving direction, the system comprising:

a memory configured to store computer-executable instructions; and at least one processor configured to execute the computer-executable instructions to:

obtain sensor data associated with a vehicle, wherein the sensor data comprises at least location data of the vehicle and lateral position data of the vehicle;

identify a road segment associated with the sensor data, based on the location data and map data;

calculate half width data associated with the road segment, based on the lateral position data;

determine a confidence value, based on the half width data associated with the road segment, the lateral position data, and vehicle width data; and determine the driving direction for the vehicle, based on the confidence value.

2. The system of claim 1, wherein to determine the driving direction, the processor is further configured to:

compare the half width data associated with the road segment with a combination data, wherein the combination data is a summation of the lateral position data and the vehicle width data; and determine the driving direction as at least one of a right-way driving direction and a wrong-way driving direction, based on the comparison.

3. The system of claim 1, wherein the processor is further configured to:

determine a consecutive number of locations associated with the vehicle; and generate a notification based on the confidence value, the consecutive number of locations and a set of rules, wherein the notification comprises at least one of an alert message indicative of wrong-way driving, an audio message indicating wrong-way driving, a visual message indicating wrong-way driving, and a navigation instruction related to wrong-way driving.

4. The system of claim 3, wherein each rule in the set of rules comprises a threshold confidence value and a threshold number of consecutive locations, and wherein to generate the notification based on the confidence value, the consecutive number of locations, and the set of rules, the processor is further configured to:

select a first rule from the set of rules based on the consecutive number of locations, wherein the first rule comprises a first threshold confidence value and a first threshold number of consecutive locations;

determine whether the confidence value determined for each of the first threshold number of consecutive locations is greater than the first threshold confidence value;

select a second rule from the set of rules, in response to determining the confidence value determined for at least one of the first threshold number of consecutive locations is not greater than the first threshold confidence value, wherein the second rule comprises a second threshold confidence value and a second threshold number of consecutive locations;

determine whether the confidence value determined for each of the second threshold number of consecutive locations is greater than the second threshold confidence value; and generate the notification, in response to at least one of: determining the confidence value determined for each of the first threshold number of consecutive locations is greater than the first threshold confidence value and determining the confidence value determined for each of the second threshold number of consecutive locations is greater than the second threshold confidence value.

5. The system of claim 1, wherein to calculate the half width data associated with the road segment, the processor is further configured to:

map-match the location data to the road segment, using the lateral position data and a heading direction data;

determine a first lateral position data and a second lateral position data for the road segment; and calculate the half width data associated with the road segment, based on the first lateral position data and the second lateral position data.

6. The system of claim 1, wherein the processor is further configured to:

determine a number of lanes on the road segment, based on the half width data associated with the road segment and a threshold lane width;

compare the determined number of lanes on the road segment with a ground truth data associated with the road segment, wherein the ground truth data includes lane data record; and validate the road segment, based on the comparison.

7. The system of claim 1, wherein to identify the road segment associated the sensor data, the processor is further configured to map-match the location data with the map data to identify the road segment associated with the sensor data.

8. The system of claim 1, wherein the road segment is a bidirectional.

9. A method for determining a driving direction, the method comprising:

obtaining sensor data associated with a vehicle, wherein the sensor data comprises at least location data of the vehicle and lateral position data of the vehicle;

identifying a road segment associated with the sensor data, based on the location data and map data;

calculating half width data associated with the road segment, based on the lateral position data;

determining a confidence value, based on at least one of the half width data associated with the road segment, the lateral position data, and vehicle width data; and determining the driving direction for the vehicle, based on the confidence value.

10. The method of claim 9, wherein the confidence value is determined by an exponential function of the half width data associated with the road segment, the lateral position data, and the vehicle width data.

11. The method of claim 9, wherein determining the driving direction further comprises determining the driving direction as at least one of a right-way driving direction and a wrong-way driving direction, based on the confidence value.

12. The method of claim 9, further comprising:

determining a consecutive number of locations associated with the vehicle;

generating a notification based on the confidence value, the consecutive number of locations, and a set of rules, wherein the notification comprises at least one of an alert message, an audio message indicating wrong-way driving, a visual message indicating wrong-way driving, and a navigation instruction related to wrong-way driving.

13. The method of claim 12, wherein each rule in the set of rules comprises a threshold confidence value and a threshold number of consecutive locations, and wherein generating the notification based on the confidence value, the consecutive number of locations, and the set of rules further comprises:

selecting a first rule from the set of rules, based on the consecutive number of locations, wherein the first rule comprises a first threshold confidence value and a first threshold number of consecutive locations;

determining whether the confidence value determined for each of the first threshold number of consecutive locations is greater than the first threshold confidence value;

selecting a second rule from the set of rules, in response to determining the confidence value determined for at least one of the first threshold number of consecutive locations is not greater than the first threshold confidence value, wherein the second rule comprises a second threshold confidence value and a second threshold number of consecutive locations;

determining whether the confidence value determined for each of the second threshold number of consecutive locations is greater than the second threshold confidence value; and generating the notification, in response to at least one of: determining the confidence value determined for each of the first threshold number of consecutive locations is greater than the first threshold confidence value and determining the confidence value determined for each of the second threshold number of consecutive locations is greater than the second threshold confidence value.

14. The method of claim 9, wherein calculating the half width data associated with the road segment further comprises:

map-matching the location data to the road segment, using the lateral position data and a heading direction data;

determining a first lateral position data and a second lateral position data for the road segment; and calculating the half width data associated with the road segment, based on the first lateral position data and the second lateral position data.

15. The method of claim 9, further comprising:

determining a number of lanes on the road segment, based on the half width data associated with the road segment and a threshold lane width;

comparing the determined number of lanes on the road segment with a ground truth data associated with the road segment; and validating the road segment, based on the comparison.

16. The method of claim 9, further comprising:

comparing the half width data associated with the road segment with a combination data, wherein the combination data is a summation of the lateral position data and the vehicle width data; and determining the driving direction as at least one of a right-way driving direction and a wrong-way driving direction, based on the comparison.

17. A non-transitory computer readable medium having stored thereon computer executable instruction which when executed by at least one processor, cause the processor to carry out operations for generating a notification, the operations comprising:

obtaining sensor data associated with a plurality of locations, wherein the sensor data associated with the plurality of locations comprises at least a plurality of locations and a lateral position data associated with each of the plurality of locations;

identifying a road segment associated with the sensor data, based on the plurality of locations and map data;

calculating half width data associated with the road segment, based on the lateral position data associated with each of the plurality of locations;

determining a confidence value for each of the plurality of locations, based on at least one of the half width data associated with the road segment, the lateral position data associated with each of the plurality of locations, and vehicle width data;

generating the notification based on the confidence value for each of the plurality of locations and a set of rules, wherein the set of rules provides at least one threshold confidence value and at least one threshold number of consecutive locations.

18. The non-transitory computer readable medium of claim 17, wherein for generating the notification, the operations further comprise:

determining whether the confidence value for each of the plurality of locations is greater than the at least one threshold confidence value; and generating the notification, if the confidence value for each of the plurality of locations is greater than the at least one threshold confidence value and if a number of the plurality of locations matches with the at least one threshold number of consecutive locations, wherein the notification comprises at least one of an alert message, an audio message indicating wrong-way driving, a visual message indicating wrong-way driving, and a navigation instruction related to wrong-way driving.

19. The non-transitory computer readable medium of claim 17, wherein the operations further comprising determining, for each of the plurality of locations, a driving direction as at least one of a right-way driving and a wrong-way driving, based on the half width data associated with the road segment, the lateral position data associated with each of the plurality of locations, and the vehicle width data.

20. The non-transitory computer readable medium of claim 17, wherein the operations further comprising validating the road segment based on the half width data associated with the road segment and a ground truth data associated with the road segment, wherein the ground truth data includes lane data record.

* * * * *